United States Patent [19]

Coers

[11] Patent Number: 4,714,175

[45] Date of Patent: Dec. 22, 1987

[54] TANK LIQUID INTERFACE SEPARATION DECK WITH LEVELING LINES

[75] Inventor: Don H. Coers, Naperville, Ill.

[73] Assignee: CBI Industries, Inc., Plainfield, Ill.

[21] Appl. No.: 936,588

[22] Filed: Dec. 1, 1986

[51] Int. Cl.[4] ..... B65D 1/24

[52] U.S. Cl. ..... 220/216; 220/221; 48/176

[58] Field of Search ..... 220/216, 221, 5 A, 22.1; 48/176

[56] References Cited

U.S. PATENT DOCUMENTS

| | | | |
|---|---|---|---|
| 1,894,535 | 1/1933 | Laird | 220/221 X |
| 1,894,536 | 1/1933 | Laird | 48/176 |
| 2,050,459 | 8/1936 | Pease | 220/216 X |
| 2,403,604 | 7/1946 | Laird | 220/216 |
| 3,419,174 | 12/1968 | Engdahl | 220/9 |
| 3,438,215 | 4/1969 | Frijlink | 62/45 |
| 3,680,729 | 8/1972 | Bonavent et al. | 220/216 X |
| 4,209,271 | 6/1980 | McCabe et al. | 405/210 |

*Primary Examiner*—Steven M. Pollard

*Attorney, Agent, or Firm*—Marshall, O'Toole, Gerstein, Murray & Bicknell

[57] ABSTRACT

A storage tank for liquids is provided with a vertically movable horizontal deck which separates a liquid above the deck from a liquid below the deck. The deck and tank have line and pulley mechanisms to prevent the deck from skewing or tilting during vertical displacement. The liquid above the deck can be the same or different than the liquid below the deck but generally they have different densities so that the deck can float at the interface between the liquids.

6 Claims, 7 Drawing Figures

TANK LIQUID INTERFACE SEPARATION DECK WITH LEVELING LINES

This invention relates to a liquid storage tank having a movable deck for isolating a liquid in the upper portion of the tank from a liquid in the lower portion of the tank. More particularly, this invention provides a liquid separating deck with deck leveling means for preventing a skew or tilt of the deck as it moves up and down with the relative volumes of the liquids above and below the deck within the tank.

BACKGROUND OF THE INVENTION

Storage of two liquids, or liquids of different densities, in a single storage tank is old and wellknown. Single tank storage may be advantageous for a number of reasons, including the reduction of facility costs and size. Such storage tanks, and the uses therefor, are shown in U.S. Pat. Nos. 3,438,215; 3,680,729 and 4,209,271.

Where it is desirable to prevent intermixing of the liquids, or to inhibit heat transfer between liquids at different temperatures within the tank, a means of mechanical separation of the liquids may be advantageously employed. Such mechanical separation may be accomplished by extending a peripherally fixed flexible membrane across the tank at the desired liquid interface. Alternately, a vertically movable deck may be utilized, which can accommodate large changes in the relative volumes of the liquids within the tank. Vertically movable separation decks are also shown in U.S. Pat. Nos. 3,438,215; 3,680,729 and 4,209,271.

As described in the prior art, the general construction of the storage tank and separation deck depend on a number of factors, including the densities of each of the two liquids, the degree of heat loss allowable through the tank walls, and the degree of heat loss and intermixing permissible between the two liquids.

A problem not addressed by the prior art concerns deck tilting or skewing. In the ideal situation, equally distributed frictional forces would exist around the periphery of the deck as a result of the sealing means between the deck and the interior of the tank. In addition, equally distributed buoyant and hydrostatic pressure forces would exist over the surfaces of the deck. In practice, however, the frictional forces around the periphery of the deck vary with irregularities at the seal, and buoyant forces vary with irregularities in the density of the deck as well as with uneven temperature distributions within the tank. These imbalanced forces may cause the separation deck to tilt or skew disadvantageously, rendering the mechanical separation barrier ineffective.

SUMMARY OF THE INVENTION

According to the present invention there is provided a novel improved storage tank, separation deck and deck leveling arrangement for storing two separate liquid volumes in the same tank, with one liquid volume being above the deck and the other volume below the deck. The liquid volumes can have the same or different chemical or physical compositions, and they can be at the same or different temperatures. However, the densities of the volumes differ from one another.

The invention more specifically comprises a liquid storage tank having vertical walls, a vertically movable separation deck inside the tank that substantially conforms to the interior surface of the vertical walls of the tank taken in horizontal section, and a deck leveling apparatus comprising a plurality of leveling lines attached to the tank which lap pulleys located on the deck, the lines and pulleys functioning to provide a balanced application of skew-resisting moment forces to the deck. A liquid having a first density can be above the deck and a liquid with a second density can be below the deck. Either the heavier or the lighter density liquid can be above the deck. Generally though the higher density liquid will be below the deck.

DETAILED DESCRIPTION OF THE DRAWINGS

So far as practical, the same or similar elements which appear in the various views of the drawings will be identified by the same reference numbers.

Figure 1:
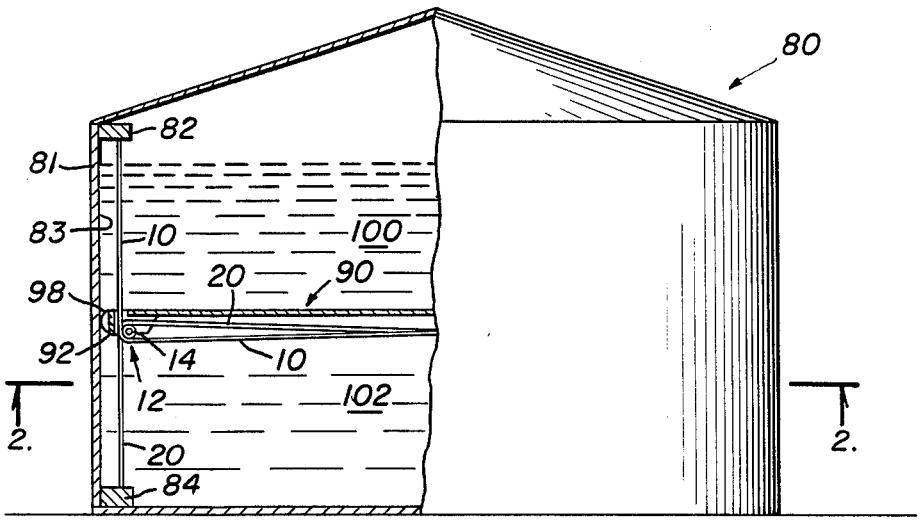
FIG. 1 is an elevation partially in section of a liquid storage tank with a separation deck and deck-leveling apparatus.

With reference to FIG. 1, the liquid storage tank 80 is shown having vertical walls 81, the vertical walls having an interior surface 83. Inside the tank 80 is positioned a separation deck 90.

Figure 2:
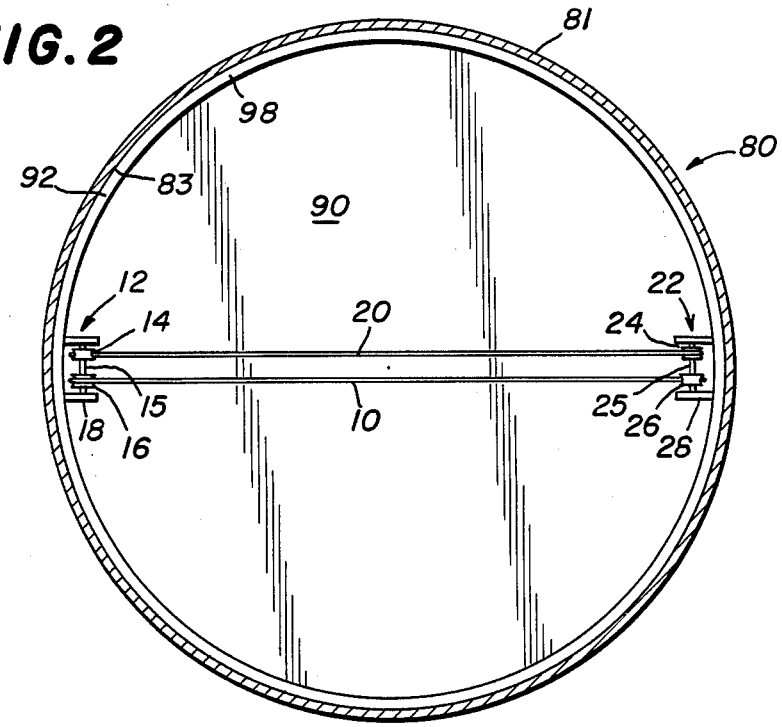
FIG. 2 is a sectional view from below the deck taken along the line 2—2 of FIG. 1.

With reference to FIG. 2, separation deck 90 has an outer periphery 92 that substantially conforms to the interior surface 83 of the tank 80 taken in horizontal section. The outer periphery 92 of the deck 90 is spaced inwardly of the interior surface 83 of the tank 80 to provide a rim space. The rim space allows the deck 90 to move vertically within the tank and clear eccentricities or imperfections on the interior surface 83 of the vertical walls 81. The rim space additionally allows for the insertion of a seal 98 between the periphery 92 of the deck 90 and the interior surface 83 of the tank walls 81. Various sealing arrangements are shown in the prior art.

The deck 90 is shown separating liquid 100 above the deck from liquid 102 below the deck. For example, liquid 100 can be hot water at 194° F. (density 0.96534 g/ml) and liquid 102 can be cold water at 50° F. (density 0.99973 g/ml). The vertical position of the deck 90 may be maintained by relying on a balance of hydrostatic pressure forces exerted on the deck by the liquid 100 above and liquid 102 below the deck. The deck in this instance may be constructed from any suitable material or materials, and it may be rigid or flexible. Alternatively, the vertical position of the deck 90 may be maintained by relying on buoyancy forces. The deck in this instance is constructed of a material or materials which provide the deck 90 with an average density between those of liquid 100 above the deck and liquid 102 below the deck. A deck with the aforesaid density will "float" between the two liquids whether the density above the deck is either greater or lesser than the density of the liquid below the deck. In general, however, the liquid beneath the deck will have a greater density than the density of the liquid above the deck. To reduce heat transfer between the liquids 100 and 102, the deck 90 may be additionally constructed of a suitable insulating material.

Figure 3:
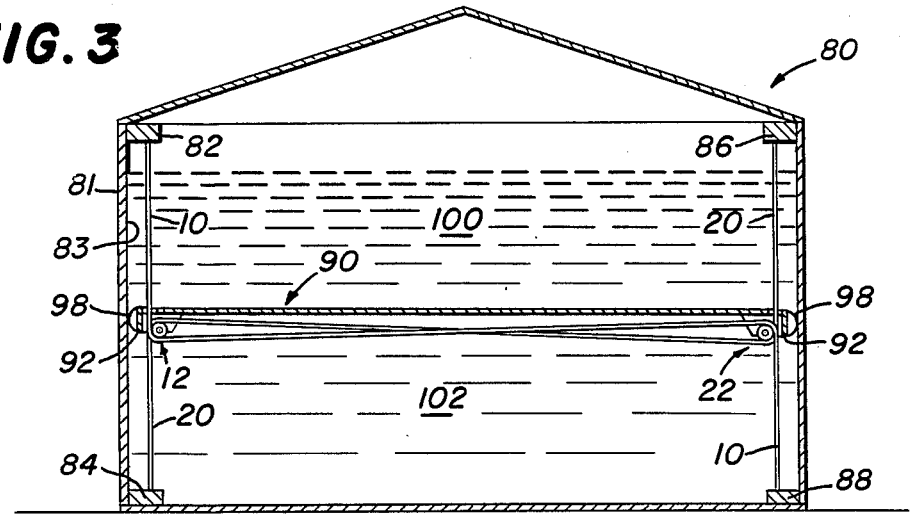
FIG. 3 is an elevational view entirely in section of the tank illustrated in FIG. 1.

FIG. 1 through FIG. 3 show one embodiment of the deck-leveling apparatus of the invention. The deck-leveling apparatus comprises complementary first and second leveling lines, 10 and 20, and first and second pulley assemblies, 12 and 22, on the deck 90 for receiving the leveling lines.

The first pulley assembly 12 includes a pair of pulley wheels, 14 and 16, mounted on an axle 15. The axle 15 is mounted to a bracket 18, which is in turn attached to the separation deck 90 at a location radially disposed from the center of the deck. The second pulley assembly 22 includes a pair of pulley wheels, 24 and 26, mounted on an axle 25. The axle 25 is mounted to a bracket 28, which is in turn mounted to the deck 90 at a location radially spaced from the center of the deck and diametrically opposite from the first pulley assembly 12. The pulley wheels are not necessarily required, however, and an alternative such as a guide slot may be employed instead.

Figure 4:
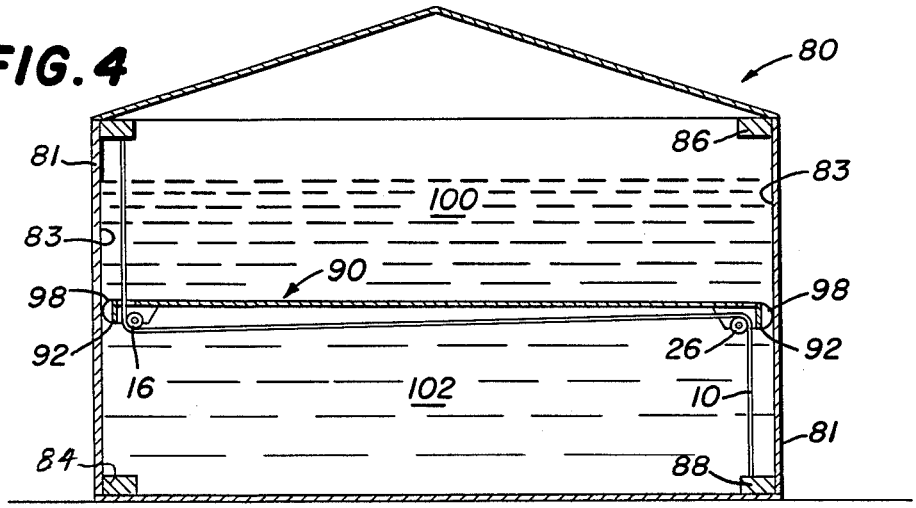
FIG. 4 is a sectional elevational view like FIG. 3 but with leveling line 20 not shown.

As shown most clearly in FIG. 2 and FIG. 4, the first leveling line 10 is attached at one end to a portion 82 of the tank 80 above and aligned with the first pulley assembly 12, and it is attached at the other end to a portion 88 of the tank 80 below and aligned with the second pulley assembly 22. The first leveling line 10 extends down from its attachment at the upper portion 82 of the tank 80 to underlap pulley wheel 16 of the first pulley assembly 12, extends from the first pulley assembly 12 to overlap pulley wheel 26 of the second pulley assembly 22, then extends down to its attachment at the lower portion 88 of the tank 80.

Figure 5:
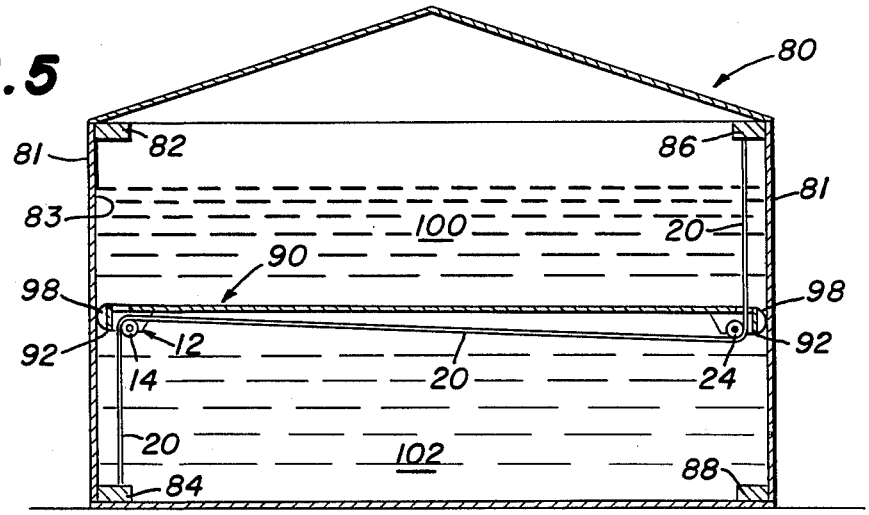
FIG. 5 is a sectional elevational view like FIG. 3 but with leveling line 10 not shown.

As shown most clearly in FIG. 2 and FIG. 5, the second leveling line 20 is attached at one end to a portion 86 of the tank 80 above and aligned with the second pulley assembly 24, and it is attached at the other end to a portion 84 of the tank 80 below and aligned with the first pulley assembly 12. The second leveling line 20 extends down from its attachment at the upper portion 86 of the tank 80 to underlap pulley wheel 24 of the second pulley assembly 22, extends from the second pulley assembly 22 to overlap pulley wheel 14 of the first pulley assembly 12, then extends down to its attachment at the lower portion 84 of the tank 80.

This arrangement of leveling lines and pulley assemblies allows the deck to move vertically in response to the relative volume of the liquids 100 and 102 within the tank 80, while at the same time applying a balanced set of skew-resisting moment forces to the separation deck 90 because of the opposite lapping of the pulley assemblies by leveling lines 10 and 20. This will prevent the deck from tilting along a line that extends between the pulley assemblies 12 and 22.

Figure 6:
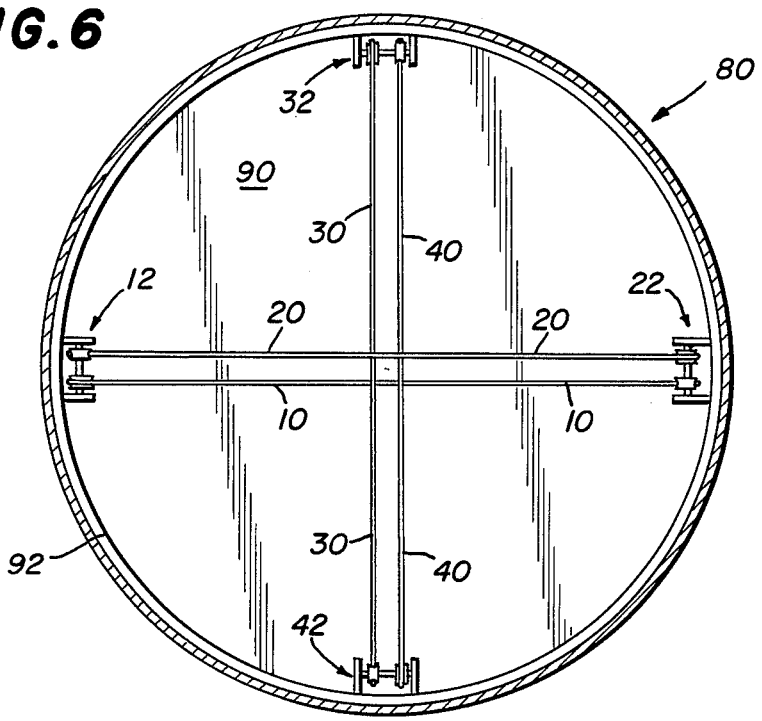
FIG. 6 is a view like that of FIG. 2 from below the deck but showing a second embodiment of the invention.
Figure 7:
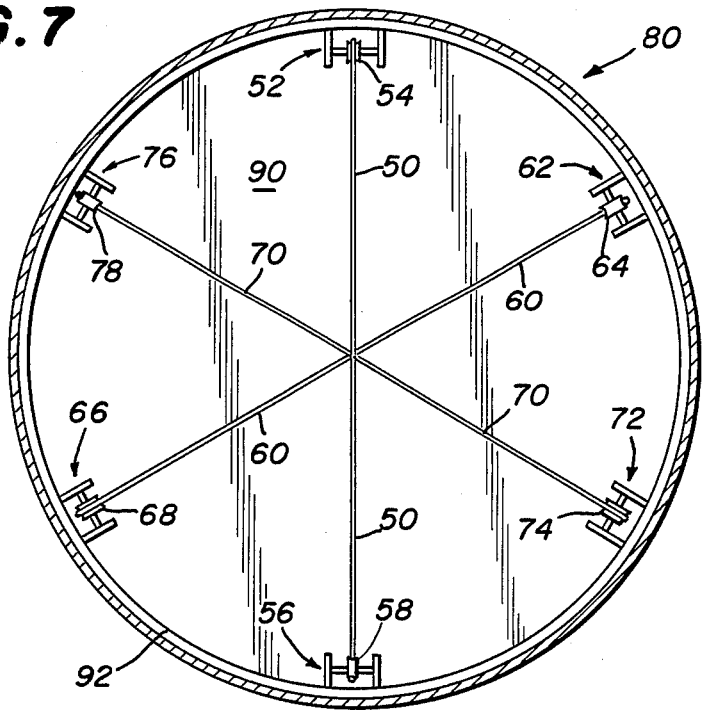
FIG. 7 is a view like that of FIG. 2 from below the deck but showing a third embodiment of the invention.

FIG. 6 and FIG. 7 show alternative arrangements of leveling lines and pulley assemblies.

FIG. 6 shows an arrangement similar to that of FIG. 1 through FIG. 5, but with the addition of complementary third leveling line 30 and fourth leveling line 40, and third and fourth pulley assemblies 32 and 42. By circumferentially spacing the third and fourth pulley assemblies 32 and 42 from first and second pulley assemblies 12 and 22, an additional balanced set of skew-resisting moment forces are applied to the separation deck 90 that will prevent the deck from tilting along a line that extends from the third pulley assembly 22 to the fourth pulley assembly 42, further adding to the stability of the deck.

FIG. 7 shows still another arrangement where there are three leveling lines 50, 60 and 70; and three pairs of pulley assemblies 52 and 56, 62 and 66, and 72 and 76 corresponding to each leveling line. Each of the pulley assemblies are spaced radially from the center of the deck 90, each pulley assembly within the pair being spaced from the other. Further, the pulley assemblies are spaced at equal angular intervals on the deck 90 in such a manner as to apply a balanced arrangement of skew-resisting moment forces to the deck.

Leveling line 50 is attached at one end to a portion of the tank above and aligned with pulley assembly 52, and is attached at the other end to a portion of the tank below and aligned with pulley assembly 56. Leveling line 50 extends down from its attachment at the upper portion of the tank to underlap pulley wheel 54 of pulley assembly 52, extends to pulley assembly 56 and overlaps pulley wheel 58, then extends down to its attachment at the lower portion of the tank.

Leveling line 60 is attached at one end below and aligned with pulley assembly 62, and it is attached at the other end to a portion of the tank above and aligned with pulley assembly 66. Leveling line 60 extends up from its attachment at the lower portion of the tank to overlap pulley wheel 64 of pulley assembly 62, extends to pulley assembly 66 and underlaps pulley wheel 68, then extends up to its attachment at the upper portion of the tank.

Leveling line 70 is attached at one end to a portion of the tank above and aligned with pulley assembly 72, and it is attached at the other end to a portion of the tank below and aligned with pulley assembly 76. Leveling line 70 extends down from its attachment at the upper portion of the tank to underlap pulley wheel 74 of pulley assembly 72, extends to pulley assembly 76 and overlaps pulley wheel 78, then extends down to its attachment at the lower portion of the tank.

Modifications of the embodiments described to include any number and placement of leveling lines and pulley assemblies can be made and, to the extent that such modifications incorporate the spirit of the invention, they are intended to be included within the scope of the appended claims.

The foregoing detailed description has been given for clearness of understanding only, and no unnecessary limitations should be understood therefrom, as modifications will be obvious to those skilled in the art.

What is claimed is:

1. In combination:

a liquid storage tank having vertical walls said walls comprising an interior surface;

a vertically movable deck inside said tank and having a center and an outer periphery that substantially conforms to said interior surface of said tank vertical walls in horizontal section;

said deck outer periphery spaced inwardly from said interior surface of said tank vertical walls to provide a rim space;

a deck leveling means comprising complementary first and second leveling lines and first and second pulley means on said deck for receiving said lines;

said pulley means being radially spaced from the center of the deck;

said first pulley means being diametrically opposite said second pulley means;

said first leveling line being attached at one end to the upper portion of said tank above and aligned with said first pulley means;

said first leveling line being attached at the other end to the lower portion of said tank below and aligned with said second pulley means;

said first leveling line extending down from said attachment at the upper portion of said tank to underlap said first pulley means;

said first leveling line further extending from said first pulley means to overlap said second pulley means;

said first leveling line then extending down from said second pulley means to said attachment at the lower portion of said tank;

said second leveling line being attached at one end to the upper portion of said tank above and aligned with said second pulley means;

said second leveling line being attached at the other end to the lower portion of said tank below and aligned with said first pulley means;

said second leveling line extending down from said attachment at the upper portion of said tank to underlap said second pulley means;

said second leveling line further extending from said second pulley means to overlap said first pulley means; and said second leveling line then extending down from said first pulley means to said attachment at the lower portion of said tank.

2. A combination according to claim 1 further including:

a means for sealing the rim space between said outer periphery of said deck and said interior surface of said tank.

3. A combination according to claim 1 wherein:

said tank contains a liquid of a known density above said deck;

said tank contains a liquid of a known density below said deck;

the density of the liquid below the deck is different than the density of the liquid above the deck; and wherein said deck has a density between the density of the liquid above the deck and the density of the liquid below the deck.

4. In combination:

a liquid storage tank having vertical walls, said walls comprising an interior surface;

a vertically movable deck inside said tank and having a center and an outer periphery that substantially conforms to said interior surface of said tank vertical walls in horizontal section;

said deck outer periphery being spaced inwardly from said interior surface of said tank vertical walls to provide a rim space;

a deck leveling means comprising complementary first and second leveling lines and first and second pulley means on said deck for receiving said first and second leveling lines, and complementary third and fourth leveling lines and third and fourth pulley means on said deck for receiving said third and fourth leveling lines;

said pulley means being radially spaced from the center of the deck;

said first pulley means being diametrically opposite said second pulley means;

said first leveling line being attached at one end to the upper portion of said tank above and aligned with said first pulley means;

said first leveling line being attached at the other end to the lower portion of said tank below and aligned with said second pulley means;

said first leveling line extending down from said attachment at the upper portion of said tank to underlap said first pulley means;

said first leveling line further extending from said first pulley means to overlap said second pulley means;

said first leveling line then extending down from said second pulley means to said attachment at the lower portion of said tank;

said second leveling line being attached at one end to the upper portion of said tank above and aligned with said second pulley means;

said second leveling line being attached at the other end to the lower portion of said tank below and aligned with said first pulley means;

said second leveling line extending down from said attachment at the upper portion of said tank to underlap said second pulley means;

said second leveling line further extending from said second pulley means to overlap said first pulley means;

said second leveling line then extending down from said first pulley means to said attachment on the lower portion of said tank;

said third and fourth pulley means being spaced circumferentially from said first and second pulley means;

said third pulley means being diametrically opposite said fourth pulley means;

said third leveling line being attached at one end to the upper portion of said tank above and aligned with said third pulley means;

said third leveling line being attached at the other end to the lower portion of said tank below and aligned with said fourth pulley means;

said third leveling line extending down from said attachment at the upper portion of said tank to underlap said third pulley means;

said third leveling line further extending from said third pulley means to overlap said fourth pulley means;

said third leveling line then extending down from said fourth pulley means to said attachment at the lower portion of said tank;

said fourth leveling line being attached at one end to the upper portion of said tank above and aligned with said fourth pulley means;

said fourth leveling line being attached at the other end to the lower portion of said tank below and aligned with said third pulley means;

said fourth leveling line extending down from said attachment at the upper portion of said tank to underlap said fourth pulley means;

said fourth leveling line further extending from said fourth pulley means to overlap said third pulley means; and said fourth leveling line then extending down from said third pulley means to said attachment at the lower portion of said tank.

5. A combination according to claim 4 further including:

a means for sealing the rim space between said outer periphery of said deck and said interior of said tank vertical walls.

6. A combination according to claim 4 wherein:

said tank contains a liquid of a known density above said deck;

said tank contains a liquid of a known density below said deck;

the density of the liquid below the deck is different than the density of the liquid above the deck; and wherein said deck has a density between the density of the liquid above the deck and the density of the liquid below the deck.

* * * * *